US007111623B2

(12) United States Patent
Brennan

(10) Patent No.: US 7,111,623 B2
(45) Date of Patent: Sep. 26, 2006

(54) HEAT DEFLECTING BAFFLE FOR DIRECT VENT FIREPLACE

(75) Inventor: Michael G. Brennan, Dallas, TX (US)

(73) Assignee: Jeffrey Grant Designs, L.L.C., Tulsa, OK (US)

( * ) Notice: Subject to any disclaimer, the term of this patent is extended or adjusted under 35 U.S.C. 154(b) by 95 days.

(21) Appl. No.: 10/823,530

(22) Filed: Apr. 13, 2004

(65) Prior Publication Data

US 2005/0224072 A1 Oct. 13, 2005

(51) Int. Cl.
*F24C 3/00* (2006.01)
*F24B 1/195* (2006.01)

(52) U.S. Cl. ..... 126/512; 126/552; 237/70

(58) Field of Classification Search ..... 126/512 O, 126/552 X; 237/70 X, 46–48
See application file for complete search history.

(56) References Cited

U.S. PATENT DOCUMENTS 4,301,783 A * 11/1981 Buckner et al. ..... 126/521
4,607,611 A * 8/1986 Rice et al. ..... 126/531
4,793,322 A 12/1988 Shimek et al.
4,909,227 A 3/1990 Rieger
5,388,566 A * 2/1995 Smith et al. ..... 126/512
5,755,215 A 5/1998 Mickens et al.

OTHER PUBLICATIONS

Rockler Woodworking and Hardware, Catalog H4-A, p. 59 4365 Willow Drive, Medina, MN 55340.
Woodcraft, Feb. 2004, pp. 131 560 Airport Industrial Park, P.O. Box 1686, Parkersburg, WV 26102-1686.

* cited by examiner

*Primary Examiner*—Alfred Basichas
(74) *Attorney, Agent, or Firm*—James R. Head

(57) ABSTRACT

A direct vent fireplace includes a heat deflecting baffle comprised of a base member attached to the front top edge of the fireplace and an extension member telescopically attached to the base member. Each end of the extension member includes a vertical flange with a track. The base member includes a vertical flange which is received in the track along with a catch means to permit selective movement of the extension member from a retracted position to a fully extended position or to positions there between.

16 Claims, 5 Drawing Sheets

HEAT DEFLECTING BAFFLE FOR DIRECT VENT FIREPLACE

FIELD OF THE INVENTION

The present invention relates to the hearth industry, and, in particular, to improvements in direct vent fireplaces.

BACKGROUND OF THE INVENTION

Vented fireplaces come in three vent types: conventional, power and direct.

Conventional woodburning fireplaces have been used in homes throughout the years. Although these fireplaces are not usually the primary heating source in todays homes, such fireplaces remain quite popular due to their aesthetic value and charm. Conventional venting of woodburning fireplaces, of course, require some type of chimney for venting the combustion products. As will be appreciated by those skilled in the art, conventional fireplaces are typically built with an outside masonry chimney. Prefabricated woodburning fireplaces typically have metal chimneys that are installed in the outside chimney chase. In newer construction, these chimneys are often framed, and thereafter covered by siding.

Power vented fireplaces exhaust flue products using a power driven blower. They are particularly useful on horizontal or off-vertical runs where it is necessary to supplement the natural buoyancy of the flue products. The decrease in lift from the exhaust on a horizontal run can make it difficult to vent products of combustion.

In recent years, there has been a trend towards the installation of gas fireplaces. These gas fireplaces typically burn cleaner, can be turned on and off with the push of a button, eliminate the need for buying, chopping and storing wood and require little or no maintenance and/or cleaning. Such gas fireplaces were originally installed in similar fashion to conventional woodburning fireplaces, i.e., they were typically installed in the outside chases. However, newer gas fireplace technology allows the fireplace the be moved into the room, rather than being enclosed in an outside chimney chase. The newer fireplaces include both direct vent and vent free models.

Gas fireplaces of conventional design typically utilize a source of combustion air from the room being heated. This lowers the efficiency of the gas fireplace because a portion of the heated air in the room is drawn into the combustion chamber and exhausted up the chimney. It is known to provide separate ducting from the outside ambient environment to the combustion chamber to increase the efficiency of the fireplace. The ducted air provides a source of oxygen for combustion in the combustion chamber and decreases the amount of air from the room being heated which is exhausted up the chimney. Such ducting, however, requires additional materials and labor to install.

Fireplaces which burn gas and which utilize artificial log assemblies to simulate the appearance of burning wood logs are well known in the art. The artificial log assemblies typically include several artificial logs of a ceramic or other refractory material designed to simulate the appearance of wood logs. A gas burner supplies a flammable gas underneath the artificial logs. The gas is burned to produce a flame in the vicinity of the logs. The fireplace can include a tank or reservoir for holding the flammable gas or can be connected to a remote gas source. Fireplaces utilizing artificial log assemblies provide heat and the pleasing appearance of a wood fire, while avoiding the inconvenience and lace of cleanliness associated with the loading of wood into and removal of ashes from conventional wood burning fireplaces.

One objective in the design and construction of gas log fireplaces is to provide artificial logs that look like real logs and to provide gas flames which closely simulate the flames produced by burning wood so that an overall effect of burning wood is produced. Both the size and color of the flame and its position relative to the artificial logs are important in producing a realistic effect.

Other important objectives in the design and construction of gas log fireplaces include providing high heat output, providing high combustion efficiency, minimizing the soot and noxious gases produced by combustion and minimizing the cost of the fireplace.

Direct vent fireplaces have become popular as they do not affect or compromise the indoor air quality and are ideally suited for today's energy efficient, tightly constructed homes and come in a variety of designs, sizes and heat output. Also they must be in compliance with local and national safety standards, the EPA and the American National Standards Institute (ANSI).

A typical direct vent fireplace uses a two duct system which achieves the aforesaid objectives of gas log fireplaces. Combustion air is drawn from the outside of a dwelling through one duct, while the exhaust gases are vented through the other duct. This overcomes much of the problem of drawing air for combustion from within the house and allows for vertical and horizontal runs within limits specific to the fireplace specifications without the use of a fan. Such fireplaces are disclosed, e.g., in U.S. Pat. No. 4,793,322 (Shimek et al.) and U.S. Pat. No. 4,909,227 (Rieger).

Most modern direct vent type gas fireplaces are prefabricated units. The basic types are zero clearance, insert, free-standing and wall mount. A zero clearance fireplace, as its name suggests, can be placed against combustible materials. An insert is a unit made to fit within an existing solid fuel burning fireplace, and may use the existing chimney. A free-standing unit may be placed on the floor in a room without support from the wall and may be spaced a distance from the wall. A wall mount is placed on and supported by a wall in the room.

Room air flows by convection, or with the use of a fan, through a passage between the bottom of the firebox and the bottom of the unit, around the rear and sides of the firebox, and out across the top of the firebox directing heat into the room. In order to increase the efficiency of the unit, some manufacturers place a heat exchanger for top vented units in-line with the exhaust outlet over the top of the firebox in the circulating air passage. The heat exchanger impedes the flow of the exhaust gases and provides additional heat transfer surface area which allows for additional heating of the room air.

Some would consider it's not a fireplace without a mantel. It has been recognized that the flow of heated air which exits from the top of a direct vent fireplace can reach temperatures of 400° C. or higher. Accordingly, the use, size and placement of a mantel is a critical safety concern. Although mantels may be of a variety of materials, wood is usually the choice to be coordinated with room decor. Being combustible, builders and installers are advised against placing the mantel contiguous to the front face of a direct vent fireplace. An installation manual for one direct vent appliance depicts how the vertical installation clearances for combustible mantels varies according the depth of the mantel. For example, a mantel 10" (254 mm) deep is recommended to be placed 12" (305 mm) vertically above the top of the fireplace. Some mantel installations are being placed even higher, e.g., 16"–17" to escape soot blackening, charring, or even combustion of the mantel from the elevated heat as it rises from the fireplace. Direct vent fireplaces are uniquely suited for installations requiring utility shelves for position directly above the fireplace. Such shelves are commonly used for locating television sets and decorative plants. Most direct vent fireplaces include tempered glass front doors. When these doors are closed even higher temperatures rising above the fireplace may result. These situations are not optimal to safely accept the elevated BTU's (e.g., 20,000–30,000 BTU) being vented into the room.

There are direct vent fireplaces that use downwardly facing vents at the outlet. See U.S. Pat. No. 4,793,322. However, even these do not prevent the rising heat from corrupting a mantel. Accordingly a need has occurred for providing greater heat deflection away from fireplace installations having a mantel.

SUMMARY OF THE INVENTION

The present invention provides, as an object, a direct vent, typically gas, fireplace (appliance) that includes an auxiliary deflecting baffle attached contiguously to the top of the fireplace and which is adjustable outwardly-downwardly to overcome the problems associated with objects, such as mantels, that are within the immediate path of the rising heated air.

Another object of the present invention is to provide an auxiliary deflecting baffle that is a part of the original manufactured fireplace or can be a secondary market device for attachment to existing direct vent fireplaces.

A yet further object of the present invention is to provide an auxiliary deflecting baffle attached contiguously to the top of the fireplace that is of fire and heat resistant material compatible with the appliance in appearance and decor. Materials such as polished stainless steel, steel coated with heat resistant paint, or brass coating and tempered glass are within the scope of the invention.

In one aspect of the invention a direct vent gas fireplace is provided having a firebox with top, rear, bottom and two side panels, and a front with or without a viewing window or door. An outer enclosure surrounding or spaced away from the firebox includes a top, rear, bottom and two side surfaces. The outer enclosure essentially becomes the passage for room air which then exits at the top of the fireplace. In this invention, an auxiliary deflecting baffle is attached contiguously to the top of the fireplace. The baffle comprises a fixed base member attached to the top of the fireplace outer enclosure and extending outwardly-downwardly into the room that is to be heated. The fixed base member includes vertically extending side or end flanges. An adjustable extension member, also extending outwardly-downwardly is telescopically and slidably attached to the fixed base member. The second member also includes vertically extending side or end flanges that mirror image those of the first member. A detent device positioned between the vertically extending side or end flanges of the base and extension members permits lockable inward and outward positioning of the adjustable extension member. The detent device can be in the form of spring-loaded ball or pin, notches or dimples or sliding friction between the first and second members. One form of detent is a "Bullet Catch" or "Adjustable Ball Catch" found in most hardware and woodworker supply stores or catalogs. A variety of latches and catches can be found, for example in "Rockler® Woodworking and Hardware" catalog #H4-A, page 59. The purpose is to retain the base and extension members assembled together, yet allow telescopic movement of the extension member from a nested position to at least one outward position for maximum heat deflection downwardly. At least one handle may be formed as apart of the adjustable extension member to assist in moving the extension member inwardly and outwardly.

DETAILED DESCRIPTION OF THE INVENTION

Figure 1:
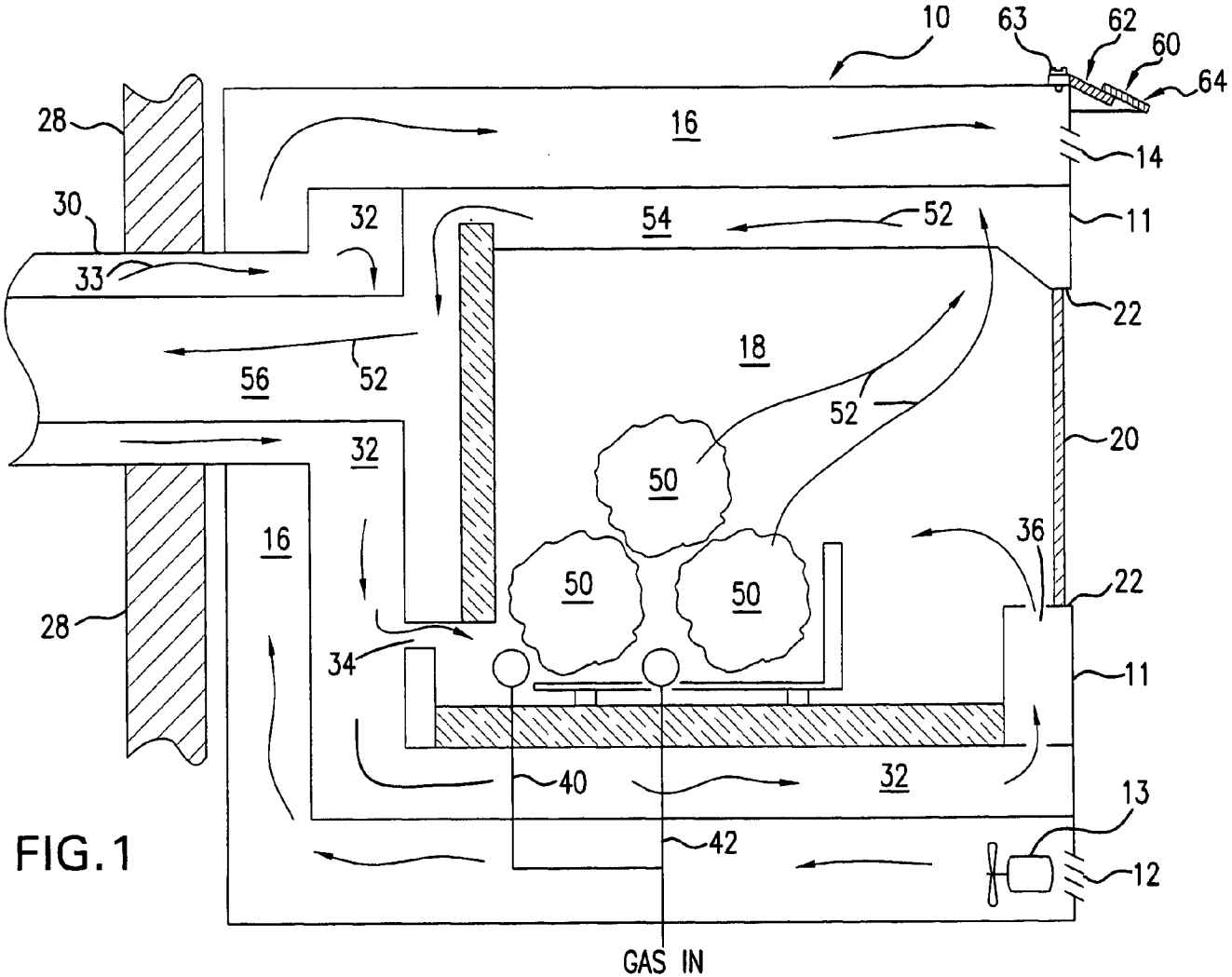
FIG. 1 is a schematic drawing in side elevation and in cross section of a typical direct vent fireplace with the device of this invention attached thereto.

Refer now to FIG. 1 showing a schematic drawing in side elevation and cross section the overall basic portions of one form of direct vent fireplace, is generally designated as 10. Such fireplaces are typically prefabricated with outer metal walls which are sufficiently cooled by air plenums or insulation so that they may be installed close to a wall or adjacent combustible materials. The fireplace comprises a front wall 11 having a room air inlet grill 12, blower 13 and a heated room air outlet grill 14 connected to the plenum chamber 16 which surrounds the fireplace combustion chamber 18 for the circulation of the room air to be heated. A glass, substantially air tight, door 20 closes a front opening 22. Being air tight helps prevent air (and oxygen) loss from the room into the combustion chamber 18. The unit is box shaped with four vertical walls (front, back and two sides) and a top and bottom as is known in the art.

The uniqueness of direct vent fireplaces is the flow of inlet combustion air from outside the house wall 28 via inlet 30, into plenum 32, thence into the fireplace combustion chamber 18. In this embodiment, combustion air flow 33, as shown by the lines and arrows, enters the combustion chamber 18 via rear inlet 34 and front inlet 36. Gas, including main and pilot, is supplied to the combustion chamber 18 through lines 40 and 42. The flames produced are caused to pass around, and up through the ceramic logs 50. The resulting combustion gasses 52 are then forced upwardly and rearwardly via plenum 54, as shown by the lines and arrows, in heat exchange contact with the circulating room air in chamber 16. The combustion air then heat exchanges with the incoming combustion air 33.

The improvement heat deflector of this invention is generally designated as 60 and comprises the fixed base member 62, attached at the top front of the fireplace with fasteners 63, and adjustable extension 64 telescopically attached to the base; member 62, which parts are shown in greater detail in the following Figures. The deflector can be of any heat resistant material such as polished stainless steel, or coated with heat resistant material of any color, such as black, gold or brass, to match the decor of the room. The deflector creates a downwardly and outwardly member, which extends, in one example, from about 2"–3" when in the retracted position to about 4"–6" in the extended position. These dimensions will vary depending upon the size of the fireplace, heat output and the height of a mantel above the fireplace. Typically the angle is less than 90°, preferrably about 45° from the front face 11, but this is not to be limiting as the angle could vary between 35° and 75°.

Figure 2:
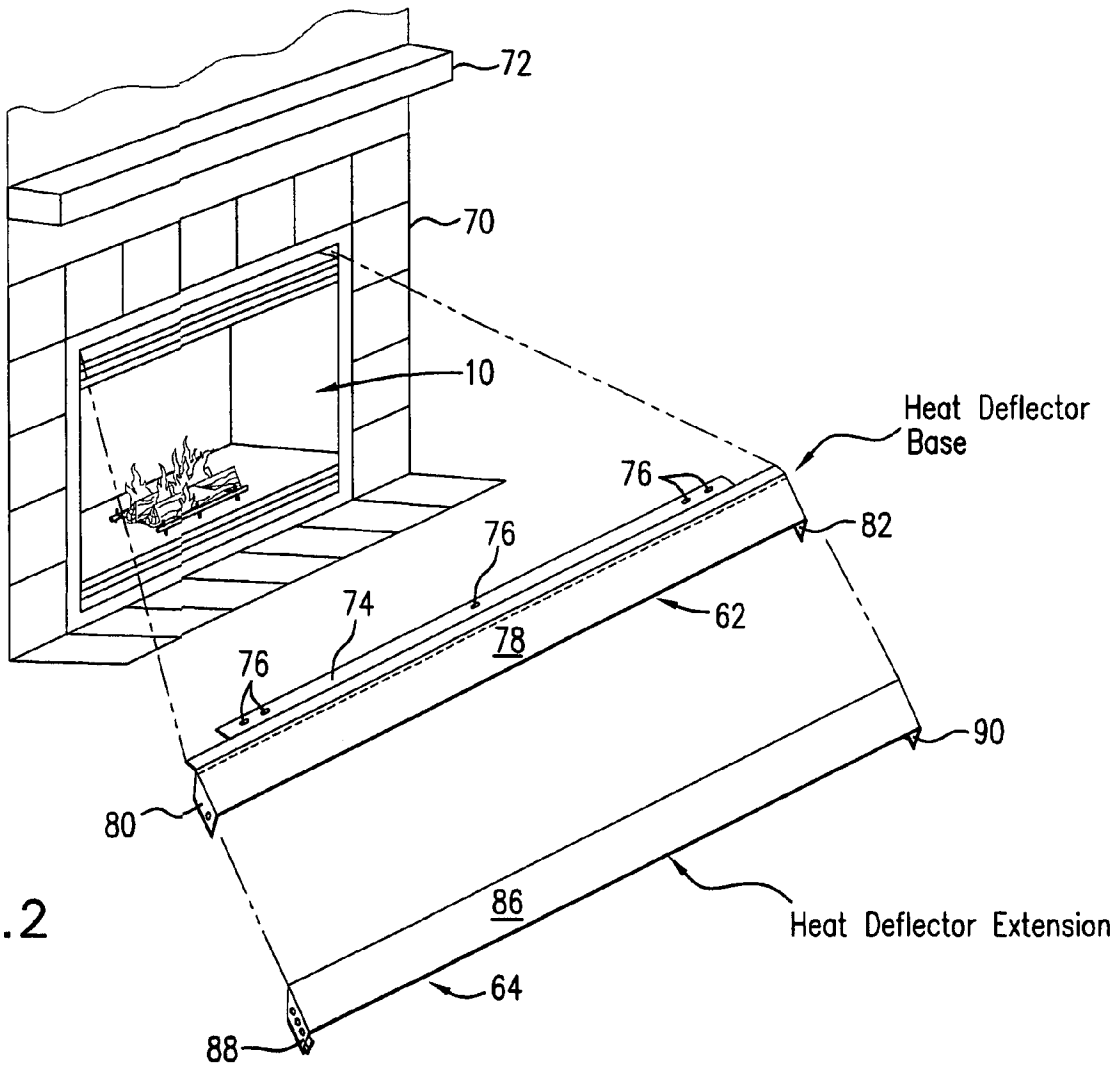
FIG. 2 is an exploded view of the basic first and second members relative to the front of the fireplace.

FIG. 2 depicts the invention in an exploded view relative to a typical fireplace 10 as positioned in a wall 70 with a mantel 72. The base member 62 includes the horizontal portion 74. Portion 74 is attached to the top of the fireplace box with fasteners 63 via openings 76. The deflector extension 78 extends downwardly. Each end of the base portion 74 includes vertical flanges 80 and 82, as described in greater detail in FIGS. 3–5. Extension 64 is comprised of a flat plate portion 86 and vertical end flanges 88 and 90 which telescopically nests with the base member 62, as described in greater detail in FIGS. 6–10.

Figure 3:
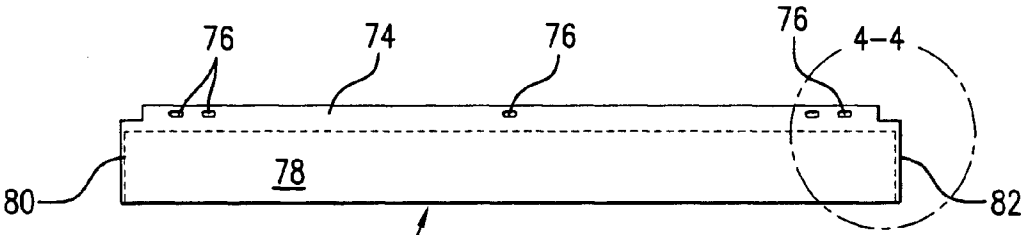
FIG. 3 is a front elevational view of the first fixed base member.
Figure 5:
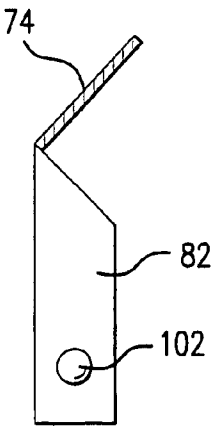
FIG. 5 is an end view taken along the line 5—5 of FIG. 4.
Figure 4:
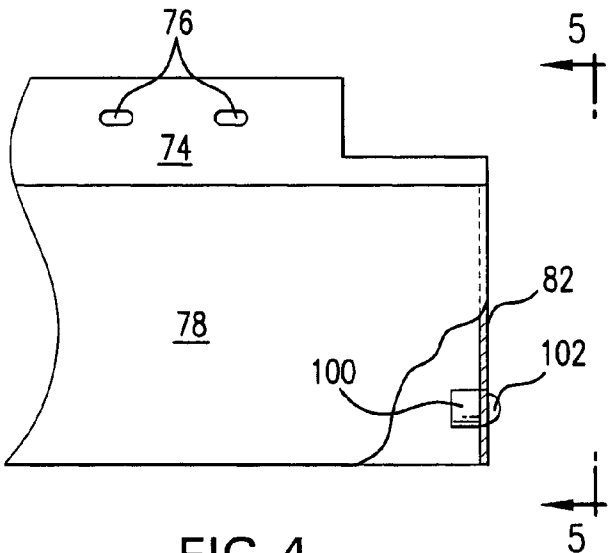
FIG. 4 is an enlarged partial view of the base member as circled at 4—4 of FIG. 3.
Figure 6:
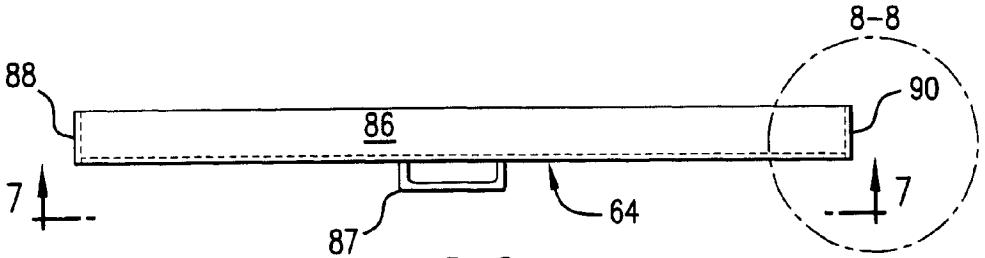
FIG. 6 is a top view of the adjustable extension member.

Referring to FIGS. 3–5 base member 62 is described in greater detail. As shown in FIG. 4, end flange 82 (likewise with end flange 80, not shown) a catch 100 is attached to the flange and, in this case, includes a spring loaded ball 102. Other types of detent means or stops are inclusive of the invention as means maintain the parts assembled, taking into consideration the expansion and contraction of the parts, and to allow telescopic movement of extension 64, yet retain it in a desired extended position.

Figure 7:
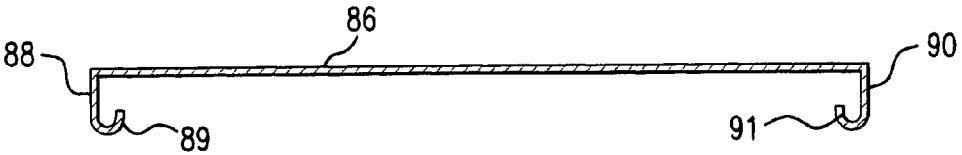
FIG. 7 is an edge view of the adjustable extension member taken along the line 7—7 of FIG. 6.
Figure 9:
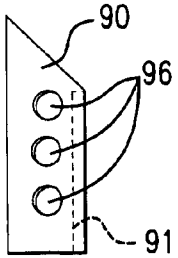
FIG. 9 is an end view taken along the line 9—9 of FIG. 8.
Figure 8:
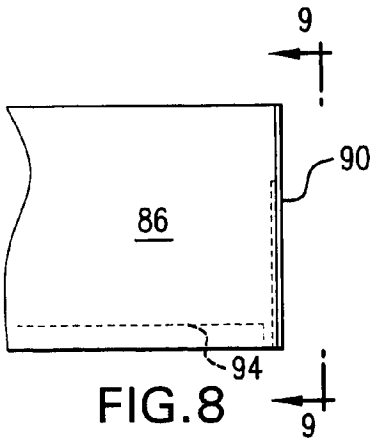
FIG. 8 is an enlarged partial view of the adjustable member as circled at 8—8 of FIG. 6.
Figure 10:
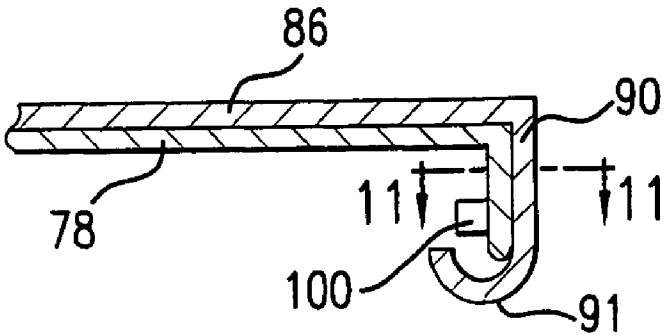
FIG. 10 is a partial sectional view of the assembled ends of the base and extension members.
Figure 11:
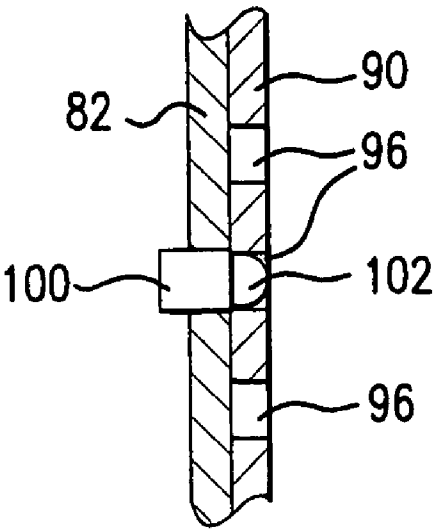
FIG. 11 is an enlarged sectional view depicting the relationship of one form of catch taken along the line 11—11 of FIG. 10 between the base and extension members.

Referring to FIGS. 6–9, the extension member 64 is depicted. An alternative embodiment includes a decorative handle, knob or pull 87 as a part of member 64. As shown in FIG. 7, the end members 88 and 90 form respective tracks 89 and 91 to receive the respective end members 80 and 82 of base member 62. In FIG. 8 the extension plate 86 can include a rounded crimped or folded edge shown dotted at 94. End flange 90 includes a plurality of openings 96 to receive detent ball or catch 102, as best described in FIGS. 10 and 11.

What I claim:

1. A fireplace defined by a combustion chamber bounded by a plurality of walls, at least one wall comprising a front wall facing room air to be heated, said front wall having a top edge and a bottom edge;

first plenum means for introducing air for combustion into said combustion chamber;

second plenum means for exhausting hot exhaust gases from said combustion chamber;

means including a blower for introducing said room air into a third air circulation plenum which creates heated room air from heat exchange contact with said second plenum means;

at least one opening at the top of said front face below said top edge to exhaust said heated room air outward of said front wall; and a separate heat deflecting baffle attached contiguous to said top edge, above said at least one opening, and extending outwardly and downwardly at an angle less than 90° to said front face whereby said heated room air is deflected downwardly, wherein said heat deflecting baffle comprises a base member attached to said top edge and an extension member telescopically attached to said base member.

2. A fireplace as claimed in claim 1 wherein said baffle is comprised of heat resistant material.

3. A fireplace as claimed in claim 2 wherein said heat resistant material is stainless steel.

4. A fireplace as claimed in claim 1 wherein each end of said extension member includes a vertical flange with a track, and wherein said base member includes a vertical flange which is received in said track, and catch means to permit selective movement of said extension member from a retracted position to a fully extended position.

5. A fireplace as claimed in claim 4 wherein said catch means is a spring loaded ball or bullet type attached to said vertical flange of said base member and said vertical flange of said extension member includes a plurality of spaced openings to receive said ball or bullet catch.

6. A fireplace as claimed in claim 1 wherein said extension member includes at least one knob or handle.

7. A fireplace as claimed in claim 4 wherein said extension member includes at least one knob or handle.

8. A fireplace as claimed in claim 1 wherein said combustion chamber is gas fired.

9. A fireplace as claimed in claim 5 wherein said combustion chamber is gas fired.

10. A fireplace defined by a gas fired combustion chamber bounded by a plurality of walls, at least one wall comprising a front wall facing room air to be heated, said front wall having a top edge and a bottom edge;

first plenum means within said walls for introducing air for combustion into said combustion chamber;

second plenum means within said walls for exhausting hot exhaust gases from said combustion chamber;

means for introducing said room air into a third plenum within said walls which creates heated room air from heat exchange contact with said second plenum means;

at least one opening at the top of said front face below said top edge to exhaust said heated room air outward of said front wall; and a heat deflecting baffle comprises a base member attached to said top edge above said one opening and an extension member telescopically attached to said base member, each end of said extension member includes a vertical flange with a track, and wherein said base member includes a vertical flange which is received in said track, and catch means to permit selective movement of said extension member from a retracted position to a fully extended position and to positions there between; and wherein said catch means is a spring loaded ball or bullet type attached to said vertical flange of said base member, and said vertical flange of said extension member includes a plurality of spaced openings to receive said ball or bullet catch.

11. A direct vent fireplace defined by a combustion chamber bounded by a plurality of walls, at least one wall comprising a front wall facing a room to be heated, said front wall having a top edge;

at least one longitudinal and horizontal opening above said combustion chamber along said front wall and below said top edge for exhausting heated air into said room;

a heat deflecting baffle comprises a base member attached to a top edge of said opening; and an extension member telescopically attached to said base member, to permit selective movement of said extension member downwardly and outwardly from and between a retracted position to a fully extended position.

12. A fireplace according to claim 11 wherein said combustion chamber is gas fired.

13. A fireplace according to claim 11 wherein said heat deflecting baffle extends outwardly and downwardly at an angle less than 90° to said front wall whereby heated room air is deflected downwardly.

14. A fireplace as claimed in claim 11 wherein each end of said extension member includes a vertical flange with a track, and wherein said base member includes a vertical flange which is received in said track, and catch means to permit selective movement of said extension member from a retracted position to a fully extended position.

15. A fireplace as claimed in claim 14 wherein said catch means is a spring loaded ball or bullet type attached to said vertical flange of said base member and said vertical flange of said extension member includes a plurality of spaced openings to receive said ball or bullet catch.

16. A fireplace as claimed in claim 11 wherein said extension member includes at least one knob or handle.

* * * * *